US007617848B2

(12) United States Patent
Matheoud et al.

(10) Patent No.: US 7,617,848 B2
(45) Date of Patent: Nov. 17, 2009

(54) METHOD AND DEVICE FOR FILLING A CONTAINER WITH LIQUID GAS FROM A STORAGE TANK

(75) Inventors: Patrick Matheoud, Villeneuve la Gareene (FR); Jean-Claude Zimmer, Beauchamp (FR)

(73) Assignee: Messer France S..A.S. (FR)

( * ) Notice: Subject to any disclaimer, the term of this patent is extended or adjusted under 35 U.S.C. 154(b) by 158 days.

(21) Appl. No.: 11/659,685

(22) PCT Filed: Jul. 19, 2005

(86) PCT No.: PCT/EP2005/053485

§ 371 (c)(1),
(2), (4) Date: Feb. 7, 2007

(87) PCT Pub. No.: WO2006/015927

PCT Pub. Date: Feb. 16, 2006

(65) Prior Publication Data

US 2008/0078188 A1 Apr. 3, 2008

(30) Foreign Application Priority Data

Aug. 7, 2004 (DE) ..... 10 2004 038 460

(51) Int. Cl.
*B65B 3/04* (2006.01)
*F17C 5/02* (2006.01)
*F17C 7/02* (2006.01)

(52) U.S. Cl. ..... 141/45; 141/5; 141/50; 141/82; 141/301; 62/48.2; 62/50.1

(58) Field of Classification Search ..... 141/4, 141/5, 44, 45, 50, 82, 95, 285, 301; 62/50.1, 62/115, 48.2
See application file for complete search history.

(56) References Cited

U.S. PATENT DOCUMENTS

| | | | | | |
|---|---|---|---|---|---|
| 2,487,863 | A | * | 11/1949 | Garretson | 62/50.1 |
| 2,544,734 | A | * | 3/1951 | St Clair | 62/49.2 |
| 2,848,879 | A | * | 8/1958 | Hesson | 62/47.1 |
| 2,854,826 | A | * | 10/1958 | Johnston | 62/50.6 |
| 2,895,305 | A | * | 7/1959 | Reed | 62/48.2 |
| 3,771,317 | A | * | 11/1973 | Nichols | 62/48.2 |
| 3,946,572 | A | * | 3/1976 | Bragg | 62/50.1 |
| 4,010,779 | A | * | 3/1977 | Pollock et al. | 141/44 |

(Continued)

FOREIGN PATENT DOCUMENTS

WO WO 01/65168 A1 7/2001

(Continued)

*Primary Examiner*—Timothy L Maust
*Assistant Examiner*—Nicolas A Arnett
(74) *Attorney, Agent, or Firm*—Connolly Bove Lodge & Hutz

(57) ABSTRACT

A method and device for filling a container with liquid gas from a storage tank includes removing the liquefied gas from the storage tank and feeding it to a container via a liquid feed line through use of a delivery system. The gas is compressed in the container and is removed from the container in its gaseous state and is at least partially liquefied by cooling in a heat exchanger. The at least partially liquefied gas is fed into the liquid feed line at the suction end of the delivery device.

20 Claims, 3 Drawing Sheets

Figure 1:
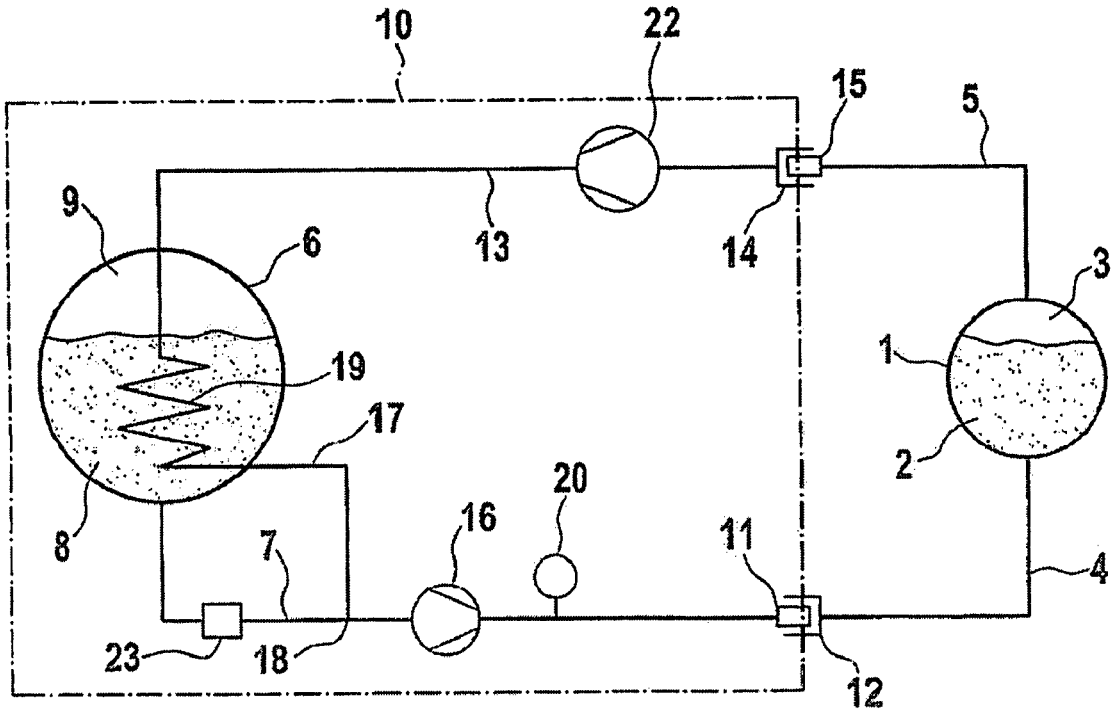

U.S. PATENT DOCUMENTS 4,211,085 A * 7/1980 Tyree, Jr. ..... 62/54.1
5,214,925 A * 6/1993 Hoy et al. ..... 62/50.6
5,353,849 A * 10/1994 Sutton et al. ..... 141/44
5,360,139 A * 11/1994 Goode ..... 141/47
5,411,374 A * 5/1995 Gram ..... 141/95
5,429,159 A * 7/1995 Tees et al. ..... 141/59
5,505,232 A * 4/1996 Barclay ..... 141/11
5,687,776 A * 11/1997 Forgash et al. ..... 141/11
5,771,946 A * 6/1998 Kooy et al. ..... 141/82
5,954,101 A * 9/1999 Drube et al. ..... 141/82
6,644,039 B2 * 11/2003 Hughes et al. ..... 62/49.1
6,889,728 B2 * 5/2005 Kamikozuru ..... 141/231
6,898,940 B2 * 5/2005 Gram et al. ..... 62/50.6
6,948,323 B2 * 9/2005 Matheoud ..... 62/48.2
7,021,341 B2 * 4/2006 Viegas et al. ..... 141/82

FOREIGN PATENT DOCUMENTS

WO WO 02/081963 * 10/2002

* cited by examiner

METHOD AND DEVICE FOR FILLING A CONTAINER WITH LIQUID GAS FROM A STORAGE TANK

The invention relates to a method and a device for filling a container with a liquid gas from a storage tank.

A liquid gas container is usually filled by pumping the liquid gas in liquid form from a storage tank into the container. In order to bring about pressure equalization between the storage tank and the container, the gas phases of the liquid gas in the container and those in the storage tank are flow connected to one another simultaneously via a separate gas line. In this way, a quantity of gas which corresponds to the volume of the liquid gas fed to the container passes into the storage tank.

A disadvantage with this previously known filling method is that, if the container to be filled is contaminated, the gas phase of the storage tank is also contaminated in the process. If further containers are filled from this storage tank, these containers are also contaminated. Furthermore, during subsequent refilling of the storage tank, there is the risk that the main tank will also be contaminated at the production site of the liquid gas.

Such so-called cross contamination can be avoided with tanking systems which only have a connecting line for liquid gas between the storage tank and the container to be filled. In this case, there is thus no longer pressure equalization between the gas phases of the storage tank and the container. In order to avoid an excessive build up of pressure in the container, it is necessary, when filling, to allow the gas phase located in the container to escape into the surroundings. However, when the gas phase is discharged into the surroundings, considerable noise emissions and local air pollution can occur. In addition, the severe loss of gas of up to 5% of the total quantity is hardly economically acceptable.

WO 01/65168 A1 discloses a method and a device for filling a container with liquid gas from a storage tank in which the liquid gas is transferred from the storage tank into the container in a fluid gas feed line by means of a multistage delivery device. The gas phase of the container to be filled is connected to a gas return line which leads into the liquid gas feed line from the storage tank in the region between two pump stages of the delivery line. While the device is operating, gas in the volume of the liquid gas which is fed to the storage tank is removed from the container, liquefied and fed, in liquid form and together with liquid gas from the storage tank, back into the container. As a result, automatic pressure regulation takes place in the container. The gas phases of the container and storage tank do not have a flow connection, as a result of which cross contamination is prevented. However, a disadvantage with this method is the large amount of expenditure on equipment and the practical difficulty of adapting the pumping capacity of the individual delivery stages to the respective requirements.

WO 02/081963 A1 describes another method for filling a container with liquid gas from a reservoir tank in which, likewise in order to avoid decontamination of the supply tank, there is only one feeder line for connecting liquid phases of the two containers, and no connection between the gas phase of the container to be filled or that of the storage tank. Liquid gas is delivered in a known fashion via the fluid gas feed line by means of a suitable pump, from the reservoir tank into the container to be filled. In order to bring about pressure equalization in the container, the gas phase of the container is connected to a heat exchanger in which the gas is cooled and largely liquefied. The liquefied gas is then fed to an injector, for example a Venturi nozzle, which is arranged upstream of the pump in the liquid feed line in order to avoid cavitation caused by a pressure drop. In the Venturi nozzle the liquefied gas which flows from the heat exchanger is mixed with the liquid gas flowing in the liquid gas feed line. According to the teaching of WO/081963, the heat exchanger is preferably arranged in the interior of the storage tank, and the cooling of the gas removed from the container to be filled therefore leads simultaneously to the vaporization of liquid gas in the storage tank, thus bringing about a pressure increase in the storage tank which promotes the filling process.

The system which is described in this document effectively prevents cross contamination during the filling process. Irrespective of the initial conditions in the containers, this system brings about a flow equilibrium in which the pressure in the pressurized container to be filled is slightly higher than the pressure in the storage tank. The pressure difference in the two containers depends only on the capacity of the heat exchanger and the quantity of liquid gas fed.

However, in the system it is disadvantageous that it is generally not possible to liquefy completely the gas which is introduced via the injector. The greater or lesser amount of gaseous substance remains, and this substance considerably reduces the efficiency of the filling process. As a result, it is necessary to use pumps which are comparatively stronger and thus more expensive and more energy intensive in use. In particular, when the system is used in mobile filling devices, for example tanker trucks, this leads to considerably higher expenditure in the construction of the vehicles.

The object of the present invention is therefore to specify a possible way of filling a container with liquid gas from a storage tank which requires a relatively small degree of expenditure on equipment and nevertheless reliably avoids cross contamination between the container and storage tank.

According to the invention, gas in the liquid state is fed, by means of a delivery device, from a storage tank to the container to be filled, and the gas phase present in the container to be filled is compressed. Gas is removed from the container to be filled, fed to a heat exchanger and at least largely liquefied. The at least largely liquefied gas is mixed with the liquid gas from the storage tank at the suction end of the delivery device and then delivered together with it into the container. Although a certain degree of cavitation in the suction region of the delivery device occurs during the introduction of the at least partially liquefied gas, with modern liquid pumps a small proportion of up to several percent gas can be accepted in the delivered stream of liquid without significantly restricting performance. The compression in the pump greatly reduces this proportion of gas. With the procedure according to the invention it is possible to dispense with using an injector, a Venturi nozzle or other devices by means of which the reliquefied gas is delivered into the container or the liquid feed line to the container.

A further embodiment of the invention provides for the differential pressure between the pressure in the container and the pressure in the storage tank to be measured directly or indirectly, and for the gas which is liquefied in the heat exchanger to be fed to the liquid feed line only when a predefined, minimum differential pressure is present. This suppresses the production of cavitations in the liquid feed line. The precise level of the minimum differential pressure depends here on the selection of the equipment used, in particular on the characteristic of the heat exchanger, the delivery capacity of the pump and the ability of the pump to tolerate a certain proportion of gas in the delivered stream without a considerable drop in pumping capacity. The minimum differential pressure to be selected for the respective equipment can, for example, be determined empirically before a refueling unit which operates according to the invention is put into operation or supplied. The differential pressure is expediently measured continuously here or at regular time intervals. The differential pressure or the pressure can be measured in the containers themselves or in the region of the feed lines and discharge lines or at some other point provided that it is possible to determine the differential pressure at the shutoff fitting unambiguously from the measurement.

One preferred embodiment of the invention makes use of the proven arrangement which is known from WO 02/081963 A1 in order to embody the heat exchanger in such a way that heat is exchanged between the liquefying gas and the liquid gas in the storage tank. In this way, there is therefore a transfer of heat from the container to the storage tank. The heat which is generated during the condensation of the gas out of the container is used for vaporizing gas in the storage tank and in this way maintaining the gas pressure in the storage tank even during the removal of the liquid gas.

In order to increase further the efficiency of the method according to the invention, a further advantageous embodiment of the invention provides for the gas which is removed from the container to be filled to be compressed before being fed to a heat exchanger. This can be done, for example, by means of a compressor which is arranged in the gas discharge line.

The object on which the invention is based is also achieved by means of a device having the features specified in claim 5.

The device according to the invention therefore comprises a liquid feed line which is connected to the storage tank, can be connected to the container and is equipped with a delivery device for delivering liquid gas into the container, and with a gas discharge line which can be connected to the container, which passes through a heat exchanger and has a flow connection to the liquid feed line at a connecting point arranged at the suction end of the delivery device. The delivery device transports gas in the liquid state via the liquid feed line from the storage tank into the container to be filled. Gas is removed from the container and fed to the heat exchanger via the gas discharge line. In the heat exchanger, heat is extracted from the gas, and the gas is as a result at least partially liquefied. The liquefied gas is fed into the liquid feed line.

The heat exchanger is expediently embodied in such a way that it brings about thermal contact between the gas which has been removed from the container, and the gas which is present in the liquid and/or gaseous state in the storage tank. Heat is therefore transferred from the gas in the storage tank to the gas from the container to be filled. The heat exchanger can be arranged at any desired location in the surroundings of the storage tank, but particularly satisfactory transfer of heat is achieved if the heat exchanger is arranged inside the storage tank.

In one development of the invention, a control device is arranged in the gas discharge line, said control device being composed of a shutoff fitting which is arranged downstream of the heat exchanger in terms of fluid dynamics, and of a device for measuring the differential pressure upstream and downstream of this shutoff fitting, which device activates the shutoff fitting when a predefined pressure condition is reached. Instead of measuring the differential pressure at the shutoff fitting it is also possible to use the pressure difference between the storage tank and the tank to be filled and to actuate the shutoff fitting.

Here, it is possible to use as the shutoff fitting any suitable fitting by means of which a pressure difference can be maintained, that is to say for example a throttle, a butterfly valve or a valve. However, a valve which is standardized or can be standardized and opens or closes at a predefined or individually adjustable value of the differential pressure is particularly preferably used.

In order to increase further the efficiency of the device according to the invention, a further embodiment of the invention provides for a compressor to be arranged in the gas discharge line, preferably in the region between the container to be filled and the heat exchanger.

One expedient development of the invention provides for an apparatus for preventing backflow of liquid gas into the storage tank, for example a nonreturn valve, to be provided in the region between the storage tank and the connecting point. The risk of cross-contamination is thus avoided in particular disruption in the operational sequence.

Another advantageous embodiment of the invention provides for a multistage pump to be provided as the delivery device, and for the connecting point to be provided in the liquid feed line between two pump stages.

One expedient embodiment of the invention provides for the storage tank and/or the container to be arranged in a mobile supply unit such as, for example, a tanker truck or a railroad tank car.

Figure 2:
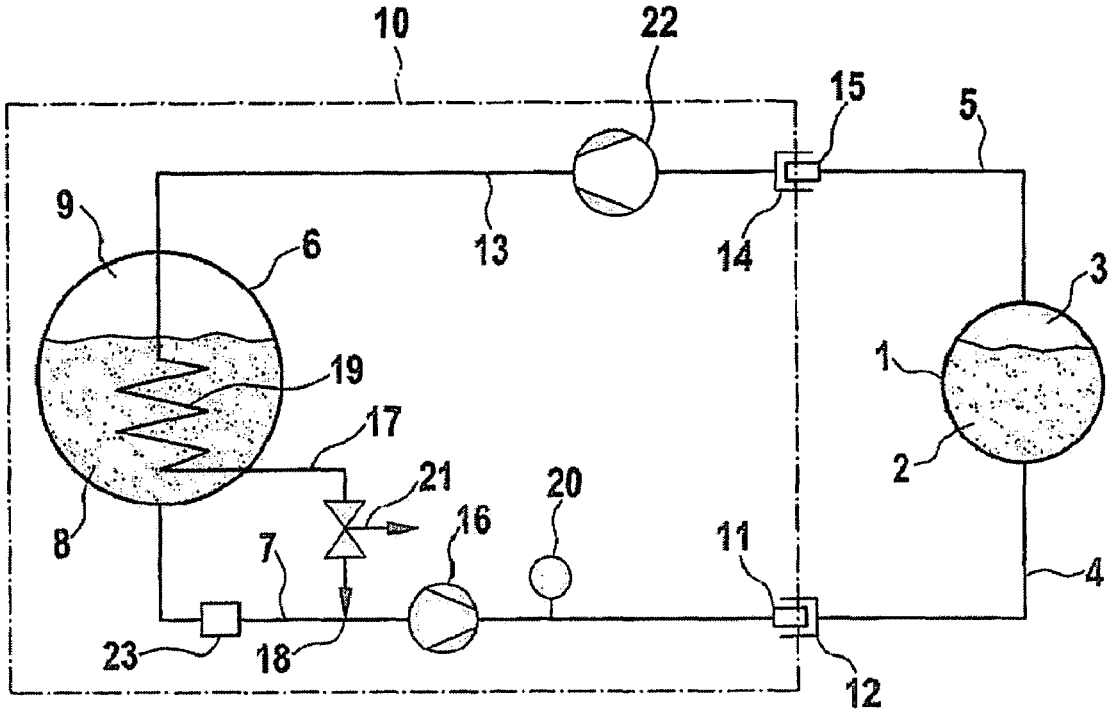
Figure 3:
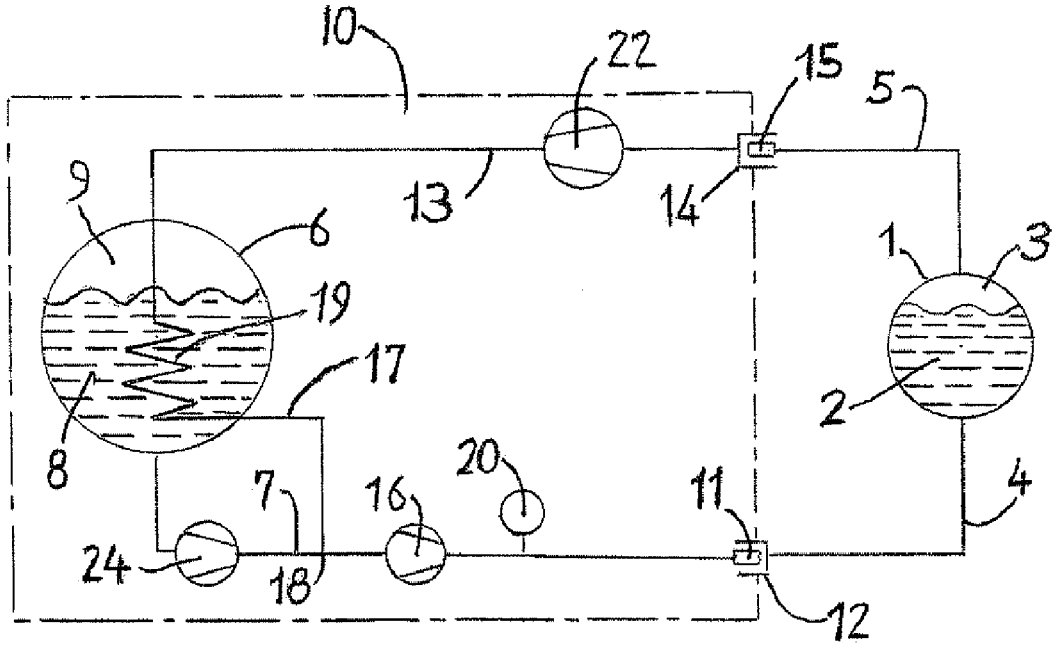

Exemplary embodiments of the invention will be explained in more detail with reference to the drawings, in which, in schematic views:

FIG. 1 shows a first embodiment of a device according to the invention for filling a container with liquid gas, FIG. 2 shows another embodiment of a device according to the invention for filling a container with liquid gas, and FIG. 3 shows an embodiment similar to FIG. 2, but wherein the non-return valve is replaced by a pump stage.

FIG. 1 shows a container 1 which is intended for storing liquid gas, for example carbon dioxide. In the state of thermal equilibrium, the liquid gas is stored in the container 1, both in the liquid phase 2 and in a gas phase 3. The container 1 is also provided (in a way which is not of interest here and is therefore not shown) with connections for supplying actuators with gas in the liquid or gaseous state. For the purpose of filling, the container 1 is equipped with in each case one liquid connecting line 4 and with a gas return line 5.

The container 1 is supplied with fresh liquid gas from a storage tank 6. The storage tank 6 is part of a refueling system 10 which is mounted, for example, on a mobile tank unit, for example a tanker truck or a railroad tank car. However, the refueling system 10 can also be a fixed system which is installed, for example, in the vicinity of a production site for the liquid gas and is intended for filling a mobile container or refueling system which is mounted on a tanker truck or a railroad tank car; the container 1 can also be a storage tank for supplying liquid gas to other containers or customers' tanks, which container 1 is itself part of a refueling system of the type described here. Apart from the storage tank 6, the refueling system 10 has the devices described below. In order to fill a container, a liquid gas line 7 is arranged on the storage tank 6. As in the container 1, the liquid gas is also present in a liquid phase 8 and a gas phase 9 in the storage tank 6. The liquid gas line 7 opens into the storage tank 6 in a lower region, and therefore forms a flow connection to the liquid phase 8 of the liquid gas stored in the storage tank 6.

The liquid gas line 7 opens, at its end remote from the storage tank 7, into a connecting element 11 by means of which a detachable connection can be produced to a corresponding connecting element 12 on the liquid connecting line 4. Furthermore, a gas line 13, which can likewise be connected by means of a connecting element 14 to a connecting element 15 on the return line 5, is also provided in the refueling unit 10.

A pump 16, which is intended to deliver liquid gas (in the liquid state) from the storage tank 6 into the container 1, is arranged in the liquid gas line 7, downstream of the storage tank 6. A flow meter 20 is provided downstream of the pump 16 in order to measure the mass flow rate.

The gas line 13 opens, at its end opposite the connection 14, into a heat exchanger 19. The heat exchanger 19 brings about thermal contact between the gas flowing into the heat exchanger 19 from the gas line 13 and the liquid gas in the interior of the storage tank 6, and is arranged in the interior of the storage tank 6 in the exemplary embodiment, specifically in such a way that gas is fed into the heat exchanger 19 from above, that is to say through the gas phase 9, and the surfaces of the heat exchanger have good thermal contact with the liquid phase 8. From the heat exchanger 19, the gas which is now cooled and at least partially liquefied passes into a line 17 which is connected to the liquid line 7 at a connecting point 18 arranged at the suction end of the delivery device 16. In the liquid gas line 7, the gas which flows in from the line 17 is mixed with the liquid gas removed from the storage tank 6, and the said inflowing gas is then fed, together with this liquid gas, to the liquid phase 2 of the gas in the container 1.

When the device is being used appropriately, the connecting elements 11 and 12 are connected to one another in order to bring about a flow connection between the storage tank 6 and the container 1 to be filled. At the same time, the connecting elements 14 and 15 are connected to one another. By means of the pump 16, liquid gas in the liquid state is forced into the container 1, as a result of which the pressure in the container 1 is increased. Gas flows in the gaseous state out of the gas phase 3 of the liquid gas present in the container 1 via the gas lines 5 and 13 into the heat exchanger 19. As a result of the exchange of heat with the liquid phase 8 of the liquid gas in the storage tank 6, the gas is cooled to such an extent that it at least partially condenses and is transported on in the in the line 17 in the at least largely liquid state. The heat which is input into the storage tank 6 during this exchange of heat causes part of the liquid phase 8 to vaporize and contributes to maintaining or even increasing the pressure in the interior of the storage tank 6 despite the ongoing removal of liquid gas.

The greater the degree to which the pump 16 increases the pressure in the container 1, and thus in the heat exchanger 19, the more reliably is it ensured that the liquid gas is at least largely in liquid form in the region of the connecting point. Nevertheless, some of the gas can remain in the gaseous state. For example, it is assumed that the relaxing of the gas at the junction from the line 17 into the liquid phase 7 by 2 bar leads to a cavitation of 5% of the gas fed from the line 17. Since the proportion of liquefied gas from the line 17 is only approximately 5% of the total quantity of liquid gas delivered by the pump 16, only a total of 0.25% of the quantity of gas delivered by the pump is present as cavitation, that is to say in the gaseous state. However, such low cavitation can be accepted without difficulty by most commercially available pumps.

In order to avoid liquefied gas flowing back from the heat exchanger 19 into the storage tank 6 when disruption occurs in the operational sequence, for example when there is a sudden failure of the pump, a device for preventing backflow, for example a nonreturn valve 23, is installed in the liquid gas line 7 between the storage tank 6 and the connecting point 18 in terms of fluid dynamics. The same function is performed by using a multistage pump provided that the connecting point 18 is arranged between two pump stages.

In order to increase the efficiency of the device according to the invention it is appropriate, but not absolutely necessary, to provide a compressor 22 in the gas line 13 upstream of the heat exchanger 19, which compressor 22 promotes the feeding of liquefied gas into the liquid feed line 7.

The embodiment according to FIG. 2 differs from the previously described one merely in having one additional control device 21 in the line 17, arranged upstream of the connecting point 18 in terms of fluid dynamics. Furthermore, identical components to those in FIG. 1 are provided with the same reference symbols.

The control device 21 comprises a shutoff fitting, for example a valve, a butterfly valve or a throttle, by means of which the flow through the line 17 can be influenced. In addition, the control device 21 has a differencial pressure measuring device by means of which the pressure difference can be determined upstream and downstream of the shutoff fitting in terms of fluid dynamics, and which acts on the shutoff fitting as a function of the pressure difference, that is to say for example opens or closes the shutoff fitting at a specific value of the pressure difference. The control device 21 can in the simplest case be implemented, for example, by means of a pressure valve which is standardized or can be standardized and which opens, or else closes, the line 17 above a specific pressure difference. Furthermore, the pressure difference can also be measured by measuring the differential pressure between the lines 7 and 13 or the containers 1 and 6, or else indirectly by measuring the respective absolute pressures and calculating the difference therefrom. The control device 21 ensures that liquefied gas flows out of the line 17 into the liquid gas line 7 only above a specific pressure difference upstream and downstream of the control device 21, and the pressure upstream of the control device 21 is, for example, 1.5 to 2 bar higher than the pressure downstream of the control device 21 here. Cavitations in the liquid gas line 7, as a result of which the efficiency of the pump 16 can be decreased, are as a result reduced to such an extent that the delivery of the liquid gas by the pump 16 is not adversely affected. The control device can also be set to a relatively low pressure difference value or else can close the line 17 when a specific overpressure value is overshot, in order to prevent cross-contamination into the storage tank 6. The value for the minimum pressure difference depends on various parameters of the equipment used, in particular on the characteristic of the heat exchanger, the flow rate to be coped with by the pump, and the capacity of the pump to tolerate a certain proportion of gas in the delivered stream without a considerable reduction in the delivery capacity.

The device according to the invention feeds back the gas removed from the container 1 into the container 1 in a circuit. As a result, the container 1 can be filled without the risk of decontamination of the liquid gas in the storage tank 6. The device according to the invention is suitable for filling containers with any liquid gases or mixtures of gases.

FIG. 3 shows a device similar to that of FIG. 2. In FIG. 3, however, the non-return valve is replaced by a pump stage 24. Accordingly, the two umps for pump stages 16 and 24 comprise a multi-stage pump as the delivery device, with the connecting point 18 between the two pump stages.

LIST OF REFERENCE NUMERALS

1 Container
2 Liquid phase (in container 1)
3 Gas phase (in container 1)
4 Liquid connecting line
5 Gas return line
6 Storage tank
7 Liquid gas line
8 Liquid phase (in storage tank 6)

9 Gas phase (in storage tank 6)
10 Refueling system
11 Connecting element (on the liquid gas line 7)
12 Connecting element (on the liquid connecting line 4)
13 Gas line
14 Connecting element (on the gas line 13)
15 Connecting element (on the gas return line 5)
16 Pump
17 Line
18 Connecting point
19 Heat exchanger
20 Flow meter
21 Control device
22 Compressor
23 Nonreturn valve

The invention claimed is:

1. A device for filling a container with liquefied carbon dioxide from a storage tank containing carbon dioxide, having a liquid feed line which is connected to the storage tank, can be connected to the container and is equipped with a delivery device for delivering liquid carbon dioxide into the container, and having a gas discharge line which can be connected to the container, passes through a heat exchanger and has a flow connection to the liquid feed line at a connecting point arranged at the suction end of the delivery device.

2. The device as claimed in claim 1, characterized in that the heat exchanger is embodied in such a way that it brings about thermal contact between gaseous carbon dioxide removed from the container and liquid carbon dioxide in the storage tank.

3. The device as claimed in claim 2, characterized in that the heat exchanger is arranged inside the storage tank.

4. The device as claimed in claim 3, characterized by a control device which comprises a shutoff fitting which is arranged in the gas discharge line downstream of the heat exchanger, and a device for measuring the differential pressure upstream and downstream of the shutoff fitting.

5. The device as claimed in claim 4, characterized in that a valve which is standardized or can be standardized and which opens the gas discharge line when a predefined or adjustable differential pressure is reached is provided as the control device.

6. The device as claimed in claim 4, characterized in that an apparatus for compressing the gaseous carbon dioxide is a compressor arranged in the gas discharge line.

7. The device as claimed in claim 4, characterized in that an apparatus for preventing backflow of liquid carbon dioxide into the storage tank is provided in the liquid feed line between the storage tank and the connecting point.

8. The device as claimed in claim 4, characterized in that a multistage pump is used as the delivery device, and the connecting point is arranged in the liquid feed line between two pump stages.

9. The device as claimed in claim 4, characterized in that the storage tank and/or the container are arranged in a tanker truck.

10. The device as claimed in claim 1, characterized by a control device which comprises a shutoff fitting which is arranged in the gas discharge line downstream of the heat exchanger, and a device for measuring the differential pressure upstream and downstream of the shutoff fitting.

11. The device as claimed 1, characterized in that an apparatus for compressing the gaseous carbon dioxide is a compressor arranged in the gas discharge line.

12. The device as claimed in claim 1, characterized in that an apparatus for preventing backflow of liquid carbon dioxide into the storage tank is provided in the liquid feed line between the storage tank and the connecting point.

13. The device as claimed in claim 1, characterized in that a multistage pump is used as the delivery device, and the connecting point is arranged in the liquid feed line between two pump stages.

14. The device as claimed in claim 1, characterized in that the storage tank and/or the container are arranged in a mobile supply unit.

15. A method for filling a container with liquid carbon dioxide from a storage tank, in which liquid carbon dioxide is removed from the storage tank and is fed to the container via a liquid feed line by use of a delivery device, gaseous carbon dioxide is compressed in the container to be filled, gaseous carbon dioxide is removed from the container to be filled and is at least partially liquefied by cooling in a heat exchanger, and the at least partially liquefied carbon dioxide is fed into the liquid feed line at the suction end of the delivery device.

16. The method as claimed in claim 15, characterized in that the differential pressure between the pressure in the container and the pressure in the storage tank is measured directly or indirectly and the gaseous carbon dioxide which is liquefied in the heat exchanger is fed to the liquid feed line only when a predefined, minimum differential pressure is present.

17. The method as claimed in claim 16, characterized in that the gaseous carbon dioxide is liquefied in the heat exchanger by exchanging heat with the liquid carbon dioxide in the storage tank.

18. The method as claimed in claim 17, characterized in that the gaseous carbon dioxide from the container to be filled is compressed before being fed to the heat exchanger.

19. The method as claimed in claim 15, characterized in that the gaseous carbon dioxide is liquefied in the heat exchanger by exchanging heat with the liquid carbon dioxide in the storage tank.

20. The method as claimed in claim 15, characterized in that the gaseous carbon dioxide from the container to be filled is compressed before being fed to the heat exchanger.

* * * * *